US005896817A

United States Patent [19]

Hancock

[11] Patent Number: 5,896,817

[45] Date of Patent: Apr. 27, 1999

[54] COMPUTER DESK WITH TILTED WORK SURFACE

[76] Inventor: Carl M. Hancock, 351 Third Ave, No. 4, Chula Vista, Calif. 91910

[21] Appl. No.: 09/024,386

[22] Filed: Feb. 17, 1998

[51] Int. Cl.[6] ..... A47B 35/00

[52] U.S. Cl. ..... 108/50.01; 108/9

[58] Field of Search ..... 108/50.01, 50.02–6, 108/9, 92, 143; 312/223.3, 208.1, 231, 233, 285, 313, 196, 283; 248/917

[56] References Cited

U.S. PATENT DOCUMENTS

| | | | |
|---|---|---|---|
| 2,675,288 | 4/1954 | Usher | 108/9 X |
| 2,696,415 | 12/1954 | Himelson | 108/9 X |
| 2,901,832 | 9/1959 | Hulen | 108/1 X |
| 2,928,703 | 3/1960 | Paulsen | 108/9 X |
| 2,973,603 | 3/1961 | De Vincenzo | 108/9 |
| 4,314,407 | 2/1982 | Kawahara | 108/9 X |
| 4,718,630 | 1/1988 | Richard | 108/1 X |
| 4,852,500 | 8/1989 | Ryburg et al. | 108/50.01 X |
| 4,986,193 | 1/1991 | Steinhilber | 108/1 X |
| 5,324,036 | 6/1994 | Morrow | 312/223.3 X |

*Primary Examiner*—Jose V. Chen
*Attorney, Agent, or Firm*—Frank D. Gilliam

[57] ABSTRACT

A computer desk with a fixed or variable angle sloping works surface. The desk includes four legs, preferably telescoping to provide variable desk height, secured to a table top. A work surface panel is secured to the table top at an angle of from about 30 to 60°. Cut-outs are provided in the panel for receiving a computer monitor and, if desired, other components. A number of horizontal bar-like rails are secured to the panel for preventing items such as papers, files, components such as keyboards, from sliding down the panel and keeping the items readily visible and within easy reach. Optimally, horizontal inverted "T" cross section slots cooperated with inverted "T" cross section on the rails. Various platforms for other components, such as a mouse pad, may be secured to the panel in the same manner as the rails.

17 Claims, 2 Drawing Sheets

COMPUTER DESK WITH TILTED WORK SURFACE

FIELD OF THE INVENTION

This invention relates to desks; in particular, desks for use with computer equipment.

BACKGROUND OF THE INVENTION

A wide variety of desks have been developed for different purposes over the years. Today, specialized desks well adapted for use with computer equipment are in great demand.

Persons using computers at a conventional desk often develop a number of physical problems, such as carpal tunnel syndrome, upper and lower back problems etc. The increase in such problems is generally attributed to the continuous use of the keyboard and/or mouse for long periods of time without significant variations in body and arm positions. Also, many desks are not arranged to provide optimum positioning relative to the keyboard or to the other components that are used in conjunction with the computer, such as printers, floppy disk drives, papers, books, files, etc. Also most desks do not allow changes in body position during work.

A number of individual computer work stations have been developed in which the computer monitor can be raised and lowered or tilted to a desired angle relative to the user. The computer mounts that allow tilting are of little benefit, since most computer monitors either have built in tilt bases or can be easily provided with such bases. Typical of such computer work stations are those described by Tellier et al. in U.S. Pat. No. 4,365,561, Reese et al. In U.S. Pat. No. 4,567,835 and Leonard in U.S. Pat. No. 5,450,800. These devices tend to be mechanically complex and do not remedy problems of easy accessibility of computer peripherals and the need to permit significant changes in body position.

Desks have been provided with cut-out areas in the horizontal desk surface for supporting computer monitors and keyboards for vertical or tilting movement. Typical of these are the desks described by Bommarito et al. In U.S. Pat. No. 5,101,736 and Watson in U.S. Pat. No. 5,526,756. These, however, do not provide an ability to significantly change the position of the user's body relative to the desk top or provide easy access to peripherals, work papers, etc.

Thus despite the many efforts of others to provide more ergnometrically correct computer desks, there remains a serious need for improvements that would provide for more convenient access for computer peripherals, work papers, files, and allow different body positions for comfortable use.

SUMMARY OF THE INVENTION

The above-noted problems, and others, are overcome by the computer desk of this invention which basically comprises a plurality of upstanding legs, preferably four, a work surface panel mounted on said legs (typically via a frame between the legs and a table top like sheet across the proximal leg ends), with the work surface lying at an angle to the horizontal of from about 25 to 60°. While any suitable work surface panel shape could be used, generally an approximately rectangular panel with uppermost and lowermost edges and side edges is preferred. A cut-out is provided in the work surface panel, configured to receiving a computer monitor typically supported by a platform of appropriate height.

For supporting papers, books, files, etc., on the work surface panel a plurality of attachment means are provided across the panel for mounting horizontal rails. Horizontal rails are secured by the attachment means at selected location to keep the papers, etc. from sliding down the work surface panel and for keeping them clearly visible and in easy reach. Also, horizontal rails may similarly position a keyboard, a telephone, etc. in place. In addition, a longer horizontal rail is preferably secured across the work surface panel near the lower edge of the work surface panel to support papers and to provide a wrist rest for a person using a keyboard mounted centrally just above the rail.

Additional cut-out areas may be provided as desired for other accessories or computer peripherals. For example a computer could stand in such a cut-out on a platform configured so that disk slots are above the work surface panel surface, or a storage container for floppy and/or compact disks could extend through such a cutout, extending either vertically or horizontally, as desired. A mouse pad could be provided adjacent to a keyboard, either or both of which could be used on a sloping portion of the work surface panel or on a horizontal shelf secured to the work surface panel.

Preferably, the legs are telescoping, to provide a vertical adjustment relative to a user that can be varied as desired. The legs could extend so that the desk could be used as a stand-up desk, to the benefit of many users who suffer from back problems.

The sloping work surface panel can be fixed at one angle or may be adjustable. If fixed, the space between a sloping work surface panel and a table top secured to the tops of the legs could be used for files or other storage. If desired, drawers could be provided across the front of the desk, between the lower work surface panel edge and an underlying table top. A shelf can also be provided across the upper work surface panel edge to hold reference books and the like. If desired, components such as a printer may be placed in desk top cut-outs or could be placed on shelves hung beneath the work surface panel adjacent to a user. The central processing unit itself could also be placed in a cutout as mentioned above or could stand on the floor adjacent to the user.

Thus, it is apparent that the sloping work surface panel desk could be configured for a variety of computer systems and work materials, with all components and materials readily visible and usable by the person operating the system. With telescoping legs and a variable tilt top of one embodiment, plus the various attachment means and rails, the desk can be configured to be comfortable for any specific person.

BRIEF DESCRIPTION OF THE DRAWING

Details of the invention, and of preferred embodiments thereof, will be further understood upon reference to the drawing, wherein.

DETAILED DESCRIPTION OF PREFERRED EMBODIMENTS

Figure 1:
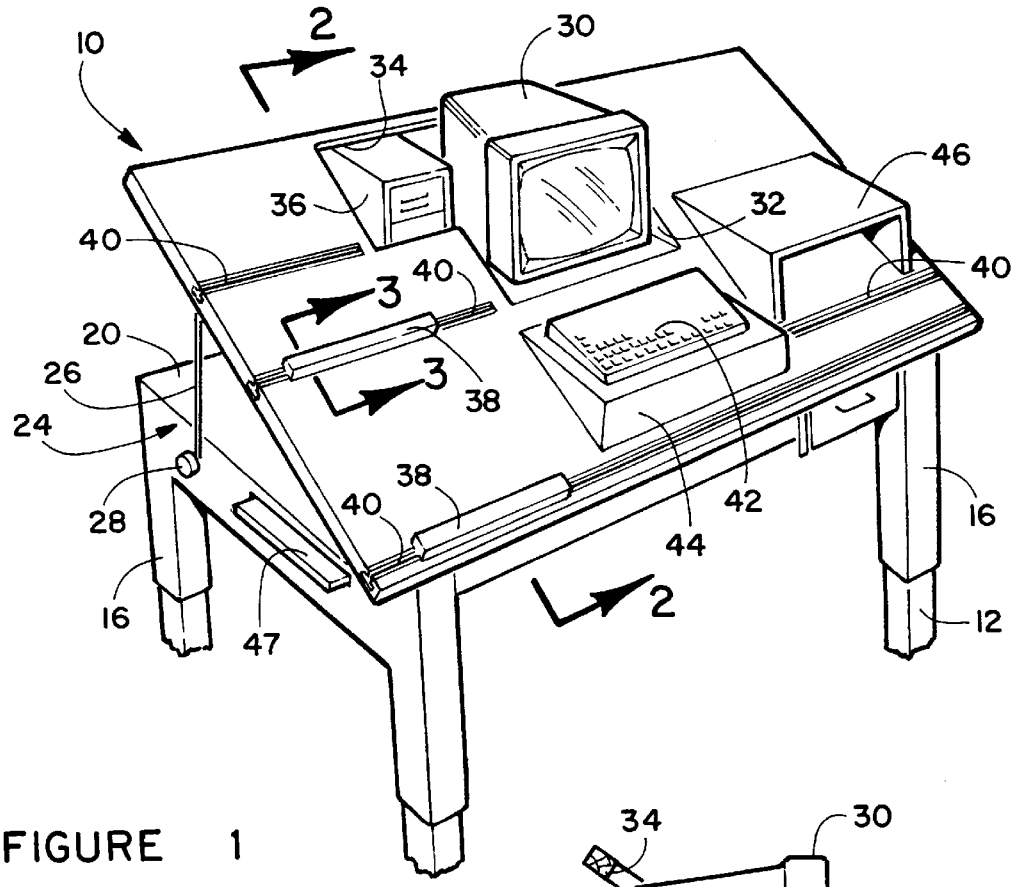
FIG. 1 is a right front perspective view of a first embodiment of the desk.
Figure 2:
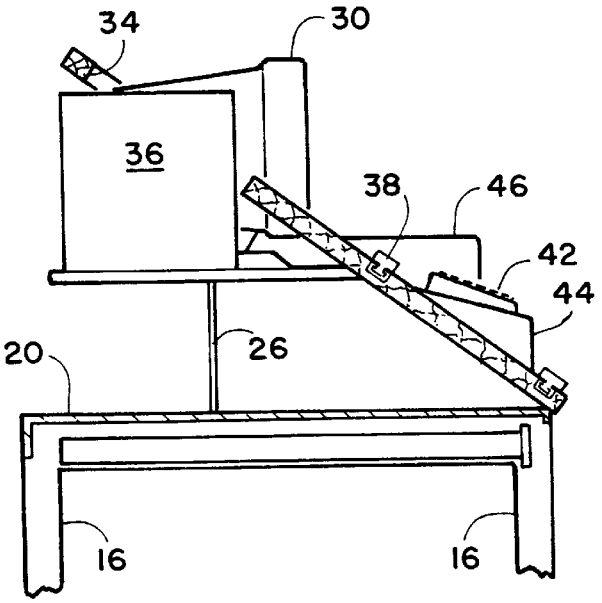
FIG. 2 is a section view taken on line 2—2 in FIG. 1.

Referring to FIGS. 1 and 2, there is seen a computer desk 10 having four legs having an upper portion 16 and a telescoping lower portion, a frame 14 fastened to the legs and a work surface panel 16 that is tiltable at a selected angle, typically between 25 and 60°. Preferably a table top 20 extends across the area bounded by frame 14.

Work surface panel 16 is mounted on table top 20 or frame 14 by a hinge 22, typically a conventional piano hinge. A conventional adjustable support 24 is provided at each end of the desk to hold work surface panel 16 at a selected angle. Support 24 is basically a longitudinally slotted bar 26 secured at one end to the underside of work surface panel 16 with a manually rotatable knob headed bolt 28 extending through the threaded into frame 14 to tighten against bar 26. In use, work surface panel 16 will be adjusted to a predetermined angle between about 25 and 60°. For storage, work surface panel 16 can be lowered into contact with table top 20.

Work surface panel 16 has a cut-out 32 configured to receive a conventional computer monitor 30. Monitor 30 stands on a platform below cut-out 32, which may be the upper surface of table top 20 or a pedestal (not seen) resting on the table top, as desired to provide a preferred screen height.

Other cut-out areas may be provided as desired for other computer system components or accessories. For example, a cut-out area 34 may be provided for computer 36 configured so that access to disk drives, etc. is permitted from above work surface panel 16.

A plurality of transverse rails 38 are removably positioned at selected positions across the upper surface of work surface panel 16. Rails 38 may be releasably secured to work surface panel 16 by any suitable fastening means, such as transverse slots, bolts through the members into T-nuts in the work surface panel, etc. In a preferred arrangement, slots 40 having an inverted "T" configuration are provided generally parallel to the lower edge of work surface panel 16 to lie in an approximately horizontal plane. The slots may be directly routed into the work surface panel surface or may preferably be in the form of slotted box section extrusions, as detailed in FIG. 3.

Rails 40 will serve to hold papers, books, files, accessories, etc. in positions selected by placement of rails on the surface of work surface panel 16 and prevent the items from sliding down the panel.

Figure 4:
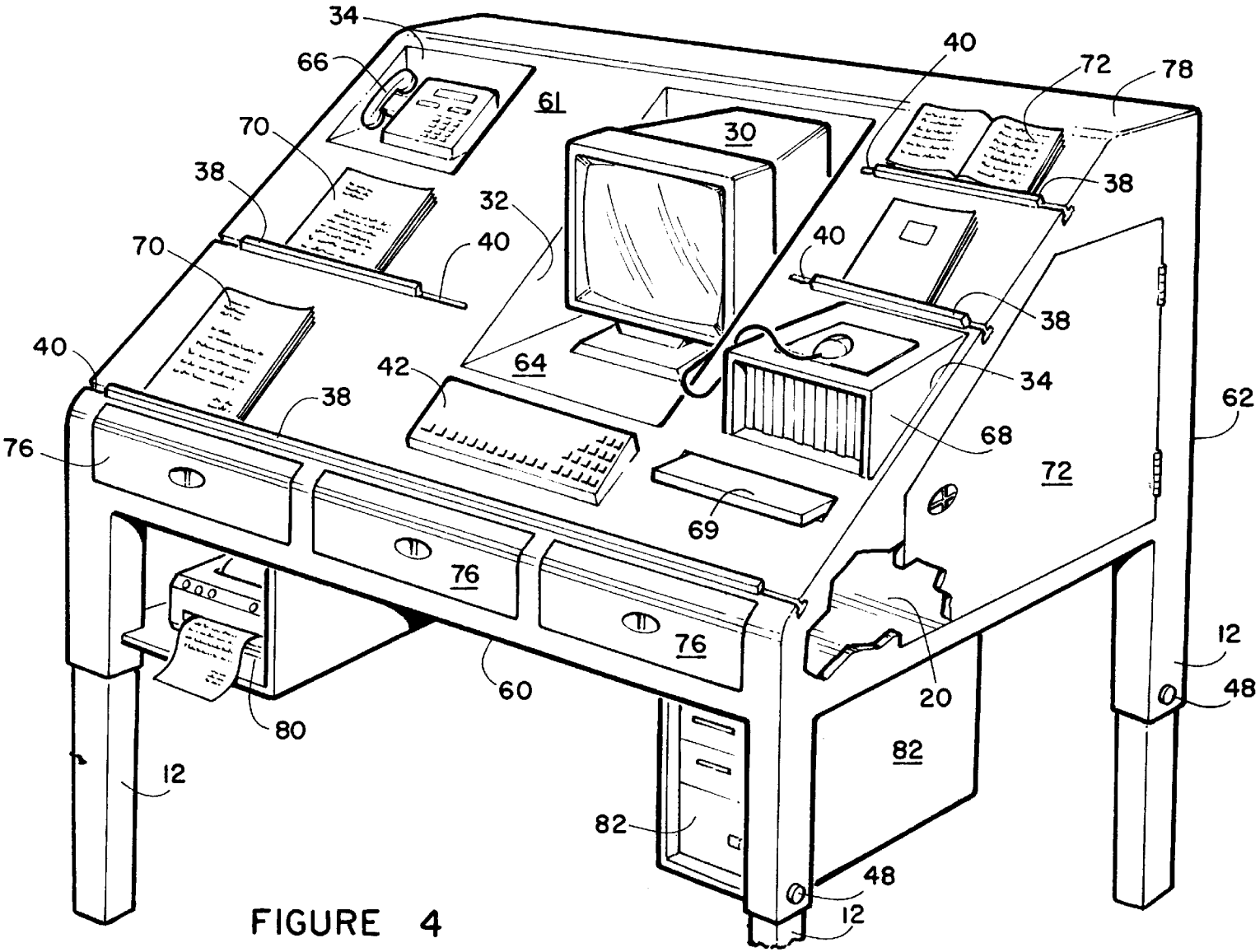
FIG. 4 is a perspective view of a second embodiment.

A keyboard 42 may simply rest on the surface of work surface panel 16, prevented from sliding downwardly by a rail 38 across the lower edge of the keyboard (as seen in FIG. 4). This rail 38 can also serve as a wrist rest (having, typically, soft padded raised upper surface. Many persons prefer a slopping keyboard for typing convenience and reduced instances of carpal tunnel syndrome. Alternatively, as seen in FIG. 1, a platform 44 may be provided to support keyboard 42. Platform 44 may either extend through an opening in work surface panel 16 (so that keyboard 42 will always lie at the same angle despite raising or lowering work surface panel 16) or be secured to the surface of work surface panel 16 via slots 40 (to vary the keyboard angle with the angle of work surface panel 16).

Various other platforms may be secured at selected locations across work surface panel 16 as desired. For example, platform 46 could be secured to work surface panel 16 through connections to slots 40 to provide a mouse pad surface. Extendable flat boards 47 may be mounted in a side of table top 20 to provide an extended horizontal work surface, as seen in FIG. 1.

Figure 3:
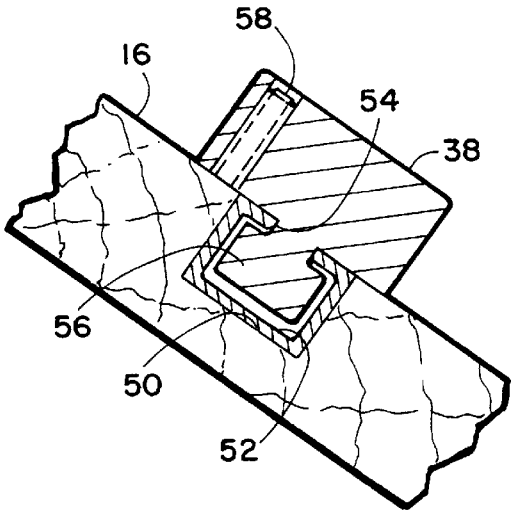
FIG. 3 is a detail transverse section view across a typical inverted "T" slot.

While any suitable method may be used to secure rails 38 to work surface panel 16, a method using a structure as seen in FIG. 3, is particularly preferred. FIG. 3 is a detail section view taken on line 3—3 in FIG. 1 transverse to a rail 38 and through a portion of work surface panel 16. A horizontal groove 50 is formed parallel to the lower edge of work surface panel 16 in any suitable manner, such as molding where work surface panel 16, routing where the panel is wood, particle board, milling where the panel is metal, etc. A channel strip 52, typically a metal or plastic extrusion, has a box cross section with a slot 54 along the exposed side. Channel strip 52 is secured in groove 50 in any suitable manner, such as adhesive bonding. Rail 38 has an inverted "T" shaped extension 56 secured thereto. Extension 56 is sized to slide along inside channel strip 52. Where rail 38 and extension 52 are formed from a metal or plastic, they may be preferably formed together by extrusion. Where rail 38 and extension 52 are formed from wood or a woodlike material, the two pieces may be made separately and bonded by an adhesive, screws, etc. Where it is desired that the rail be releasably lockable in place along a groove 52, a set screw 58 or the like may be provided, threaded through rail 38 and abutting the surface of work surface panel 16.

A second embodiment of the desk of this invention is shown in FIG. 4. The desk basically comprises four legs 12 fastened to a frame that includes a front wall 60, sloping work surface panel 61, two side walls 62 and in the back either a cover or an open area. Preferably a table top like sheet (not seen) is provided across the proximal ends of legs 12, equivalent to table top 20 as seen in FIG. 1. Legs 12 are preferably telescoping, with means such as cooperating overlapping holes and pins 48 to allow the leg lengths to be varied to allow the desk to be used as a variable height sit-down desk or a stand-up desk.

A central cutout 32 is provided in work surface panel 16 for receiving a computer terminal, which is supported at a predetermined height by a platform 64. Additional cut-out areas 34 with inset platforms may be provided for other peripherals, such as a telephone 66, a box 68 for supporting a mouse pad and containing items such as floppy or compact disks.

A keyboard 42 can be supported by work surface panel 16 forward of monitor 30, with a rail 38 engaged in a slot 40 serving to prevent the keyboard from slipping down work surface panel 16 and as a wrist support. Keyboard may be inset into a cut-out or supported by a platform similar to platform 44 discussed above.

A flat board 69 may be inserted through a slot in sloping panel 61, movable between a housed position within panel 61 and a horizontal extended position providing additional work space.

Additional slots 40 and rails 38 are provided so that rails can be placed at convenient locations to support papers 70, books 72, files, etc. Other advantageous features that may be included, if desired, include a door 74 in end wall 62 for storage of files or other items, drawers 76 at the desk front, and a shelf 78 at the top of work surface panel 16. Also, peripherals such as a printer 80 may be hung within easy reach under the desk and a computer 82 may be placed on the floor adjacent to a user.

While certain specific relationships, materials and other parameters have been detailed in the above description of preferred embodiments, those can be varied, where suitable, with similar results. Other applications, variation and ramifications of the present invention will occur to those skilled in the art upon reading the present disclosure. Those are intended to be included within the scope of this invention as defined in the appended claims.

I claim:

1. A versatile computer desk which comprises:

a plurality of legs;

a work surface panel mounted on said legs;

said work surface panel lying at an angle of from about 25 to 60° to horizontal and having generally horizontal upper and lower edges;

an approximately central cut-out having a support structure therein configured to support a computer monitor;

a plurality of attachment means in said work surface panel, said attachment means along a plane generally parallel to said upper and lower edges of said work surface and;

a plurality of elongated support rails including means for engaging said attachment means at selected locations.

2. The computer desk according to claim 1 wherein said attachment means comprises a plurality of horizontal slots in said work surface panel, each slot having an inverted "T" cross section and a plurality of rails and components having inverted "T" cross section extension configured to slidably fit within said slots.

3. The computer desk according to claim 1 wherein said legs are telescoping.

4. The computer desk according to claim 1 wherein said work surface panel is mounted on said legs via a sheet extending between proximal ends of said legs.

5. The computer desk according to claim 1 further including at least one additional cut-out area in said work surface panel with a support structure within each said additional cut-out area for receiving a predetermined peripheral device.

6. The computer desk according to claim 1 wherein said support structures comprise said sheet and platforms for placement on said sheet.

7. The computer desk according to claim 6 further including hinge mean connecting a lowermost edge of said of said work surface panel to said sheet and means for adjusting the angle between said work surface panel and said sheet.

8. The computer desk according to claim 1 further including means for fixing said work surface panel to said sheet at a predetermined angle.

9. The computer desk according to claim 8 further including at least one drawer in a space provided adjacent to a lowermost edge of said work surface panel.

10. The computer desk according to claim 8 further including at least one side wall for closing an opening between side edges of said sheet and said work surface panel, said side wall having at least one door therein.

11. The computer desk according to claim 8 further including a horizontal shelf extending along an uppermost edge of said work surface panel.

12. A versatile computer desk which comprises:

a plurality of telescoping legs;

a work surface panel mounted on said legs;

said work surface panel lying at an angle of from about 25 to 60° to horizontal and having generally horizontal upper and lower edges;

an approximately central cut-out having a support structure therein configured to support a computer monitor;

a plurality of attachment means comprising horizontal slots in said work surface panel, said slots being positioned along a plane generally parallel to said upper and lower edges of said work surface;

a plurality of elongated support rails including locking means for engaging said attachment means to permit only horizontal movement of said support rails.

13. The computer desk according to claim 12 wherein said support structures comprise said sheet and platforms for placement on said sheet.

14. The computer desk according to claim 13 further including hinge means connecting a lowermost edge of said work surface panel to said sheet and means for adjusting the angle between said work surface panel and said sheet.

15. The computer desk according to claim 12 further including means for fixing said work surface panel to said sheet at a predetermined angle.

16. The computer desk according to claim 15 further including at least one drawer in a space provided adjacent to a lowermost edge of said work surface panel and at least one side wall for closing an opening between side edges of said sheet and said work surface panel, said side wall having at least one door therein.

17. The computer desk according to claim 12 wherein said attachment means comprises a plurality of horizontal slots in said work surface panel, each slot having an inverted "T" cross section and a plurality of rails and components having inverted "T" cross section extension configured to slidably fit within said slots.

* * * * *